US006752366B2

(12) United States Patent
Chuang

(10) Patent No.: US 6,752,366 B2
(45) Date of Patent: Jun. 22, 2004

(54) STRUCTURE FOR MOUNTING SPEAKER

(76) Inventor: Po-An Chuang, 12F-2, No. 376, Tun Hwa South Road, Sec. 1, Taipei (TW)

( * ) Notice: Subject to any disclaimer, the term of this patent is extended or adjusted under 35 U.S.C. 154(b) by 187 days.

(21) Appl. No.: 10/050,187

(22) Filed: Jan. 18, 2002

(65) Prior Publication Data

US 2003/0136605 A1 Jul. 24, 2003

(51) Int. Cl.[7] ..... A47B 96/06
(52) U.S. Cl. ..... 248/220.21
(58) Field of Search ..... 248/220.21, 346.03, 248/346.04, 346.06; 381/188, 86, 205

(56) References Cited

U.S. PATENT DOCUMENTS

| | | | | | |
|---|---|---|---|---|---|
| 4,852,178 | A | * | 7/1989 | Inkman et al. | 381/395 |
| 5,133,428 | A | * | 7/1992 | Perrson | 181/153 |
| 5,699,438 | A | * | 12/1997 | Smith et al. | 381/386 |
| 6,061,460 | A | * | 5/2000 | Seo | 381/388 |
| 6,547,589 | B2 | * | 4/2003 | Magyar et al. | 439/535 |
| 2002/0172391 | A1 | * | 11/2002 | Ogawa | 381/386 |

* cited by examiner

*Primary Examiner*—Leslie A. Braun
*Assistant Examiner*—A. Joseph Wujciak, III
(74) *Attorney, Agent, or Firm*—Dennison, Schultz, Dougherty & MacDonald

(57) ABSTRACT

An improved mounting structure for mounting a speaker onto a cabinet comprising: a base seat with a sound output hole on its surface, and with an annular inner partitioning wall therein having spaced inner protruding engaging flanges at the rim at the opening of the base seat; a speaker having a mounting ring on a frame thereof for assembling with the base seat, the ring has spaced outer protruding engaging flanges thereon; and a foam body provided on the inner wall of the frame of the speaker, the foam body is abutted against the inner partitioning wall of the base seat in an airtight mode; the base seat can be embedded in various cabinets of different modeling, the outer protruding engaging flanges on the frame of the speaker are rotated to engage with the inner protruding engaging flanges, the inner partitioning wall of the base seat abuts tightly against the foam body. Such a structure is convenient for use at any location where screwing in of screws is difficult, and is surely fast in mounting the speaker.

2 Claims, 5 Drawing Sheets

STRUCTURE FOR MOUNTING SPEAKER

BACKGROUND OF THE INVENTION

1. Field of the Invention

The present invention is related to an innovative mounting structure for mounting a speaker onto a cabinet, and especially to an improved speaker mounting structure with inner and outer protruding engaging flanges for mutual fast rotation connecting, such a structure is convenient for use at spaces not easy for connecting and locking and can effectively increase air tightness of the sound output channel of the speaker.

2. Description of the Prior Art

A speaker cabinet is a terminal device for sound outputting; in addition to a main machine, a hi-fi set has a terminal end for speaker cabinets for sound outputting. Products of speaker cabinets now available are variant, not only they are used for sound outputting, but also the fact whether their appearances are streamlined and elegant can affect the styles and prices of the whole hi-fi set. Quality of a cabinet is in direct proportion to its price; various cabinets have different prices. A high class product can even cost a million dollars. Early cabinets have simpler modeling, they were almost fixed in having the shape of a rectangular cubic body; by elevation of life level, people gradually stress various streamlines, vanguard modeling, super-modern and interplanetary appearances, and even simple modeling such as stones. However, these cabinets of special modeling have uncertain internal space styles, so that locking of speakers are not so convenient as compared to those conventional cabinets in the shapes of rectangular cubic bodies; some of them have so narrow spaces that it is unable to use a screwdriver for locking, if they are locked forcedly, specific tools shall be used, and speed of assembling is reduced to result low productivity. However, if they are not locked, bad fixing may create interstices to make vibrations and noises from sound output.

In view of these, the inventor of the present invention studied hard and improved from experiments to develop the present invention.

SUMMARY OF THE INVENTION

The primary object of the present invention is to provide an improved speaker mounting structure with inner and outer protruding engaging flanges for mutual fast rotation connecting, such a structure is convenient for use at spaces not easy for connecting and locking and can effectively increase air tightness of the sound output channel of the speaker.

The secondary object of the present invention is to provide an innovative mounting structure for a speaker which is used effectively on various cabinets with modeling such as stones and with narrow spaces for locking to speedy assembling of products, and thereby increase productivity.

To achieve the above stated objects, the improved speaker mounting structure of the present invention comprises mainly: a base seat having on the surface thereof a sound output hole, the base seat has an annular inner partitioning wall with a plurality of spaced inner protruding engaging flanges; a speaker with a mounting ring on a frame thereof for assembling with the base seat, the mounting ring is provided with a plurality of spaced outer protruding engaging flanges; and a foam body is provided on the inner wall of the frame of the speaker and can abut against the annular inner partitioning wall of the base seat in an airtight mode. Thereby, the base seat can be embedded in any of various cabinets with different modeling, in order that the outer protruding engaging flanges on the frame of the speaker can be placed and rotated into engagement with the inner protruding engaging flanges, and the annular inner partitioning wall of the base seat can abut tightly against the foam body. So that such a structure is convenient for use at spaces not easy for connecting and locking of the speaker for fast assembling and fixing.

The present invention will be apparent in its combination, operation as well as its functional effects after reading the detailed description of the preferred embodiment thereof in reference to the accompanying drawings.

DETAILED DESCRIPTION OF THE PREFERRED EMBODIMENT

Figure 1:
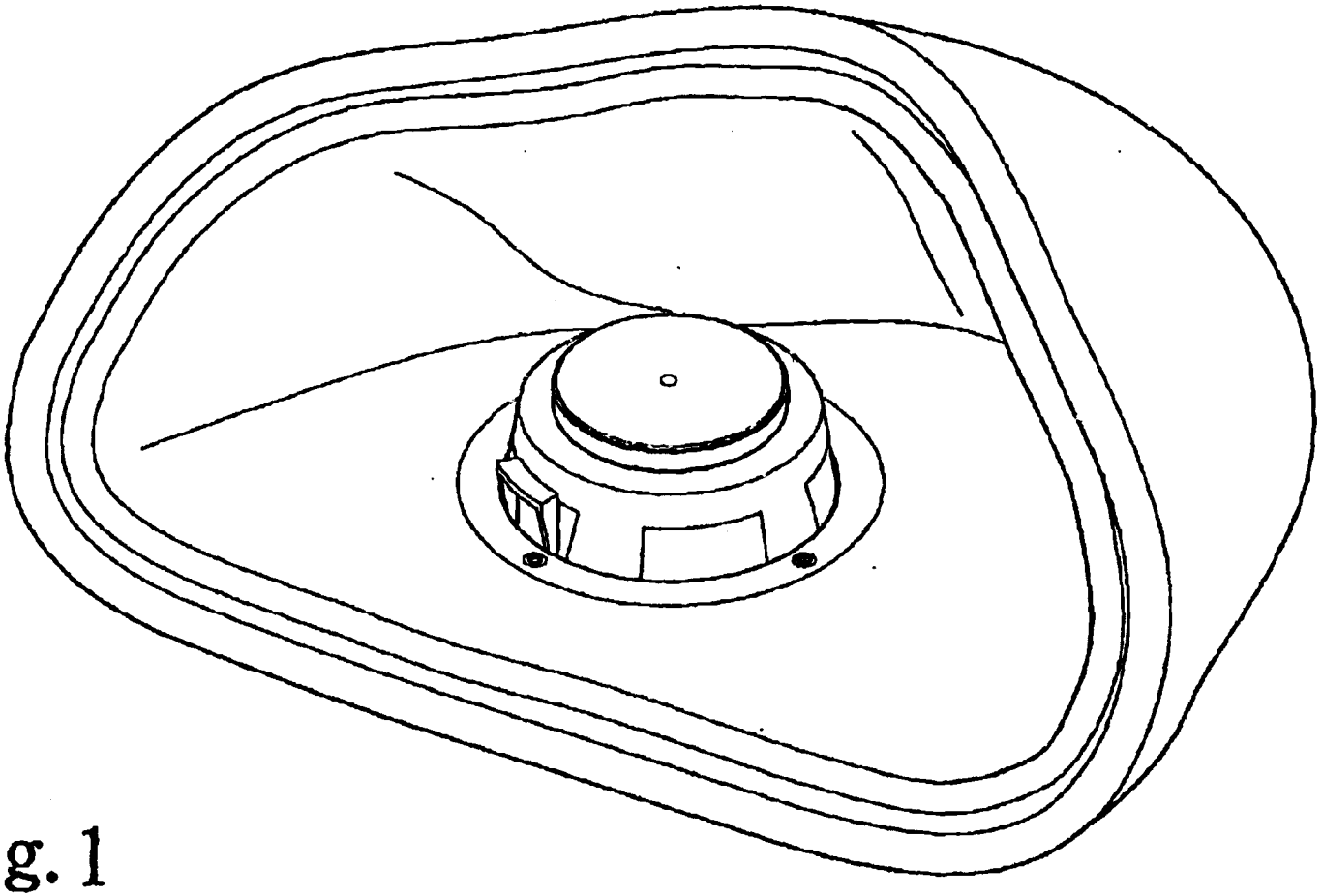
Fig. 1 Prior Art
FIG. 1 is a perspective view of a conventional structure.

Referring firstly to FIGS. 2–5, the improved speaker mounting structure of the present invention comprises mainly: a base seat 1, a speaker 2 and a foam body 3, wherein:

The base seat 1 is in the shape of a shallow disc with a sound output hole 11 on its surface, and has an annular inner partitioning wall 12 with a plurality of spaced inner protruding engaging flanges 13 at the rim at the opening of the base seat 1.

The speaker 2 has a mounting ring 22 and directly slipped over a frame 21 thereof for assembling with the base seat 1, the mounting ring 22 is provided with a plurality of spaced outer protruding engaging flanges 23.

And a foam body 3 is provided on the inner wall of the frame 21 of the speaker 2 and can abut against the annular inner partitioning wall 12 of the base seat 1 in an airtight mode.

In order to get good fixed connection between the speaker 2 and the base seat 1, the inner and outer protruding engaging flanges 13, 23 have bevel surfaces able to mutually stack and press tight, the leading ends of them mutually abutting are all provided with leading angles 24 convenient for letting in mutually, one of the bevel surfaces provided on the outer protruding engaging flanges 23 of the mounting ring 22 is provided on the end thereof with a positioning stop 25.

The base seat 1 can be round and arranged concentric with the annular inner partitioning wall 12, the foam body 3 can be an EVA ring placed on the inner wall of the frame 21 and on the outer rim 26 of the main body of the speaker, this structure leaves a receiving hole 14 at the center of the base seat to receive a tweeter 4 in a space between the base seat 1 and the speaker 2.

Figure 2:
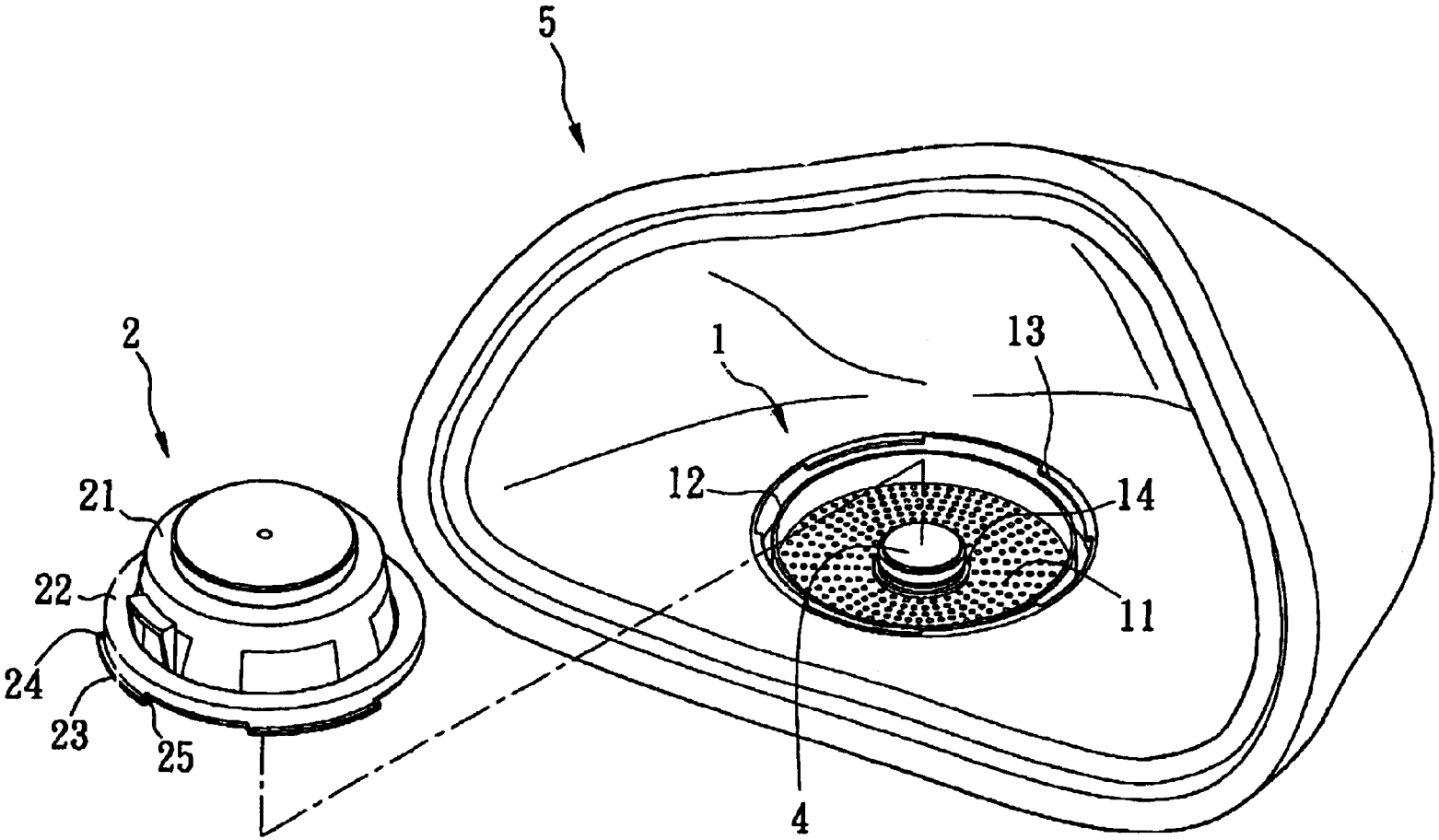
FIG. 2 is an analytical perspective view of the present invention.
Figure 3:
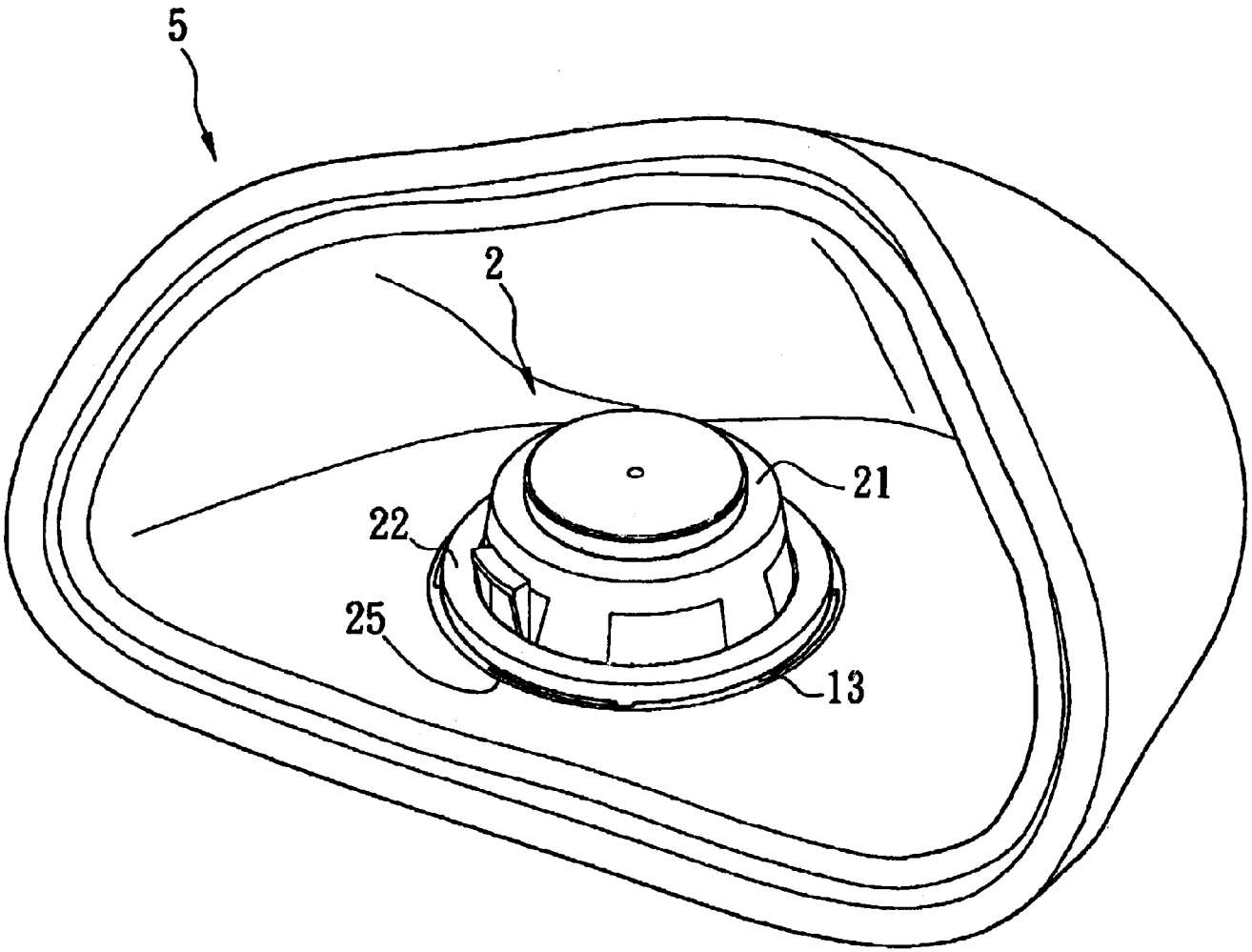
FIG. 3 is a perspective view showing assembling of the present invention.
Figure 4:
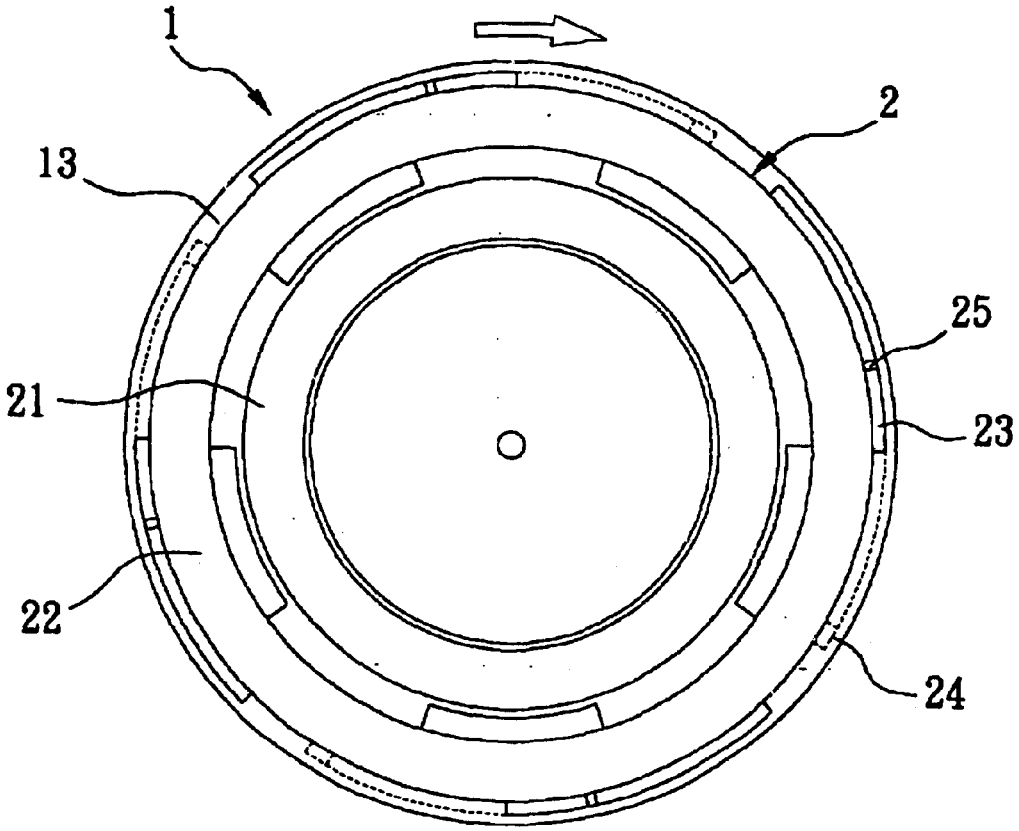
FIG. 4 is a schematic view showing mutual rotation engagement of the base seat and the frame of the speaker of the present invention.

Thereby, as shown in FIGS. 2 and 4, the present invention can be used for various cabinets with different narrow spaces. Taking the cabinet 5 with modeling of a stone of the present invention shown in FIG. 2 as an example, the base seat 1 can be embedded in the cabinet 5 at any location. Even at a location where screwing in of screws is difficult, so long that the spaced outer protruding engaging flanges 23 of the mounting ring 22 provided on the frame 21 are placed in the empty space in the opening of the base seat 1 and are rotated, the bevel surfaces of the inner and outer protruding engaging flanges 13, 23 can be mutually stacked and pressed tight, the speaker 2 can thereby be positioned by abutting of the positioning stop 25 against one of the outer protruding engaging flanges 23. In this way, convenience in mounting the speaker 2 can increase the speed of production by that the speaker 2 can be fast assembled without impediment.

Figure 5:
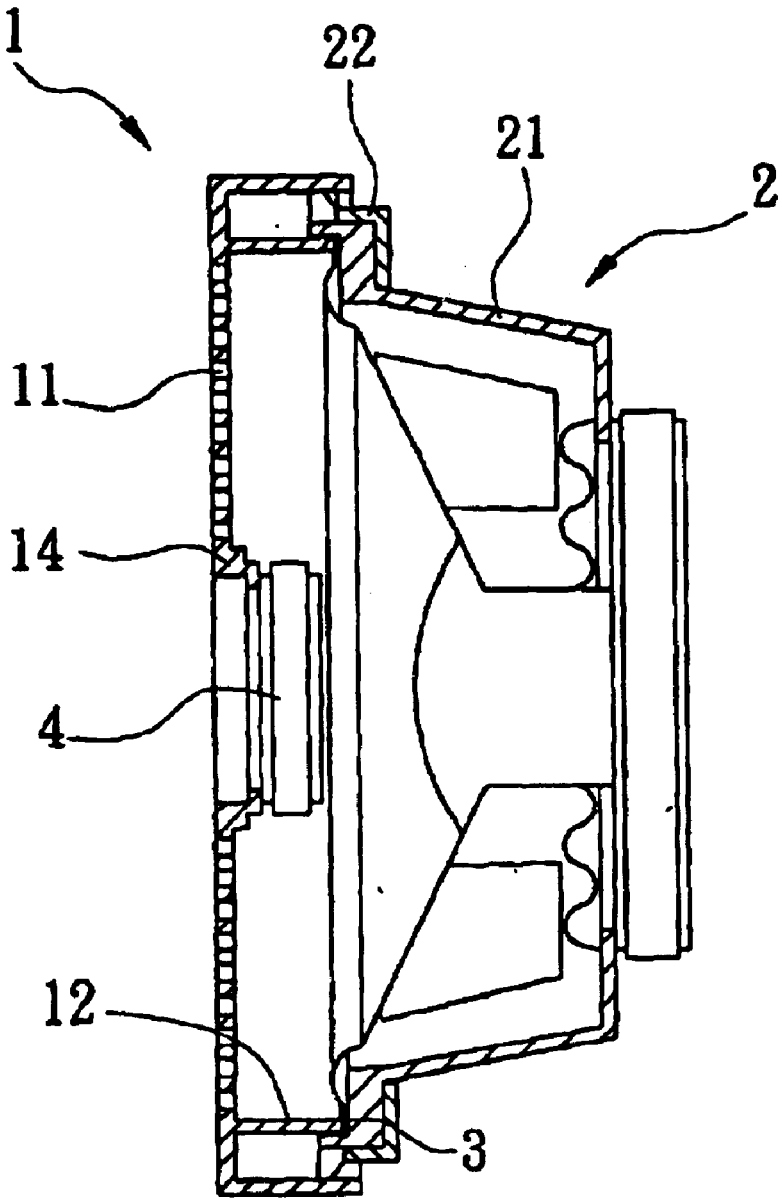
FIG. 5 is a sectional view showing assembling of the present invention.

Referring to FIG. 5, the annular inner partitioning wall 12 is arranged concentric with the base seat 1, and the inner and outer protruding engaging flanges 13, 23 are mutually stacked and pressed tight, the annular inner partitioning wall 12 can thus be place and abutted on the foam body 3 on the outer rim 26 of the main body of the speaker, hence the area behind the sound output channel of the speaker 2 can have good air tightness without noise of vibration induced by gaps.

In conclusion, the present invention is surely simple and fast in mounting the speaker, and good air tightness at the area behind the sound output channel of the speaker cam be attained. The mounting work can be widely applied to locations where screwing in of screws is difficult. The function of the present invention is far superior to that of any conventional structure, thus the present invention is industrially advanced and valuable.

The above stated is only for illustrating a preferred embodiment of the present invention, it will be apparent to those skilled in this art that various modifications or changes can be made to the elements of the present invention according to the above stated. Thereby, all such modifications and changes also fall within the scope of the appended claims and are intended to form part of this invention. Having thus described my invention, what I claim as new and desire to be secured by Letters Patent of the United States are:

What is claimed is:

1. An improved mounting structure for mounting a speaker onto a cabinet, said structure comprises:

a base seat with a sound output hole on its surface, said base seat has therein an annular inner partitioning wall with a plurality of spaced inner protruding engaging flanges at a rim at an opening of said base seat;

a speaker having a mounting ring on a frame thereof for assembling with said base seat, said mounting ring is provided with a plurality of spaced outer protruding engaging flanges; and a foam body provided on an inner wall of said frame of said speaker, said foam body is abutted against said annular inner partitioning wall of said base seat in an airtight mode;

said base seat thereby is adapted to being embedded in various cabinets of different modeling, said spaced outer protruding engaging flanges on said frame of said speaker are placed and rotated into engagement with said inner protruding engaging flanges, and said annular inner partitioning wall of said base seat abuts tightly against said foam body, so that said structure is convenient for use at any location where screwing in of screws is difficult, and is surely fast in mounting and fixing said speaker, wherein said base seat is in the shape of a shallow disc, said mounting ring of said speaker is in the shape of a ring and directly slipped over said frame; said spaced inner and outer protruding engaging flanges have bevel surfaces able to mutually stack and press tight, the leading ends of them mutually abutting are all provided with leading angles convenient for letting in mutually, one of said bevel surfaces provided on said outer protruding engaging flanges of said mounting ring is provided on the end thereof with a positioning stop.

2. An improved mounting structure for mounting a speaker onto a cabinet as in claim 1, wherein:

said foam body is placed on an outer rim of the main body of said speaker, said base seat is round and arranged concentric with said annular inner partitioning wall, a receiving hole is left at the center of said base seat to receive a tweeter in a space between said base seat and said speaker.

* * * * *